US008102361B2

(12) United States Patent
Kwak et al.

(10) Patent No.: US 8,102,361 B2
(45) Date of Patent: Jan. 24, 2012

(54) LIQUID CRYSTAL DISPLAY FOR ADJUSTING THE BRIGHTNESS OF A BACKLIGHT

(75) Inventors: Jonguk Kwak, Gumi-si (KR); Wonso Son, Gumi-si (KR)

(73) Assignee: LG Display Co., Ltd., Seoul (KR)

( * ) Notice: Subject to any disclaimer, the term of this patent is extended or adjusted under 35 U.S.C. 154(b) by 639 days.

(21) Appl. No.: 12/292,473

(22) Filed: Nov. 19, 2008

(65) Prior Publication Data

US 2009/0315821 A1 Dec. 24, 2009

(30) Foreign Application Priority Data

Jun. 24, 2008 (KR) ..... 10-2008-0059884

(51) Int. Cl.
*G09G 3/36* (2006.01)

(52) U.S. Cl. ..... 345/102; 345/207

(58) Field of Classification Search ..... 345/102, 345/207; 250/214 AL; 348/602; 349/61
See application file for complete search history.

(56) References Cited

U.S. PATENT DOCUMENTS

| | | | | |
|---|---|---|---|---|
| 6,670,595 | B1 * | 12/2003 | Sasaki et al. | 250/208.1 |
| 7,202,458 | B2 * | 4/2007 | Park | 345/102 |
| 7,554,065 | B2 * | 6/2009 | Shimizu | 250/205 |
| 7,936,346 | B2 * | 5/2011 | Kunimori et al. | 345/102 |
| 2002/0167061 | A1 * | 11/2002 | Kaifu et al. | 257/431 |
| 2006/0092115 | A1 * | 5/2006 | Matono et al. | 345/90 |

* cited by examiner

*Primary Examiner* — Chanh Nguyen
*Assistant Examiner* — Allison Walthall
(74) *Attorney, Agent, or Firm* — McKenna Long & Aldridge LLP

(57) ABSTRACT

Provided is a liquid crystal display for adjusting the luminance of a backlight of a liquid crystal display panel in accordance with the illuminance of external light. The liquid crystal display comprises: an external light sensing circuit including a photosensor, a capacitor and a write switch; and a PWM duty controller controlling the duty ratio of a pulse width modulation signal used for controlling the brightness of the back light, wherein a control signal applied to the gate electrode of the photosensor is generated at a first logic level during a sensing permitting period, and is generated at a second logic level during a sensing blocking period.

7 Claims, 7 Drawing Sheets

LIQUID CRYSTAL DISPLAY FOR ADJUSTING THE BRIGHTNESS OF A BACKLIGHT

This application claims the benefit of Korean Patent Application No. 10-2008-0059884 field on Jun. 24, 2008, which is hereby incorporated by reference for all purposes as if fully set forth herein.

BACKGROUND OF THE INVENTION

1. Field of the Invention

The present invention relates to a liquid crystal display, and more particularly, to a liquid crystal display which can adjust the luminance of a backlight according to external illuminance.

2. Discussion of the Related Art

In general, a liquid crystal display (hereinafter, LCD) has a trend that its application scope has been gradually widened due to its lightness, its thinness, and its low power consumption. In accordance with such a trend, the LCD is used in an office automation device, an audio/video device and the like. The LCD adjusts the transmittance quantity of a light beam in accordance with an image signal applied to a plurality of control switches arranged in a matrix to thereby display desired pictures on a screen.

Since the LCD device is not a self-emission type display device, the LCD device requires a light source such as a backlight. A fluorescent lamp, such as a cold cathode fluorescent lamp (CCFL) or external electrode fluorescent lamp (EEFL), or a light emitting diode, is used as the light source.

Recently, there are proposed backlight control methods which can expand the luminance range of a displayed image by adjusting the brightness of a backlight in accordance with a change in external illuminance. In these backlight control methods, a photosensor is mounted on a liquid crystal display panel to sense the illuminance of external light. Based on this sensing information, if the external illuminance is high, the brightness of the backlight is increased, and if the external illuminance is low, the brightness of the backlight is decreased, thereby achieving a reduction in power consumption in a low illumination environment and preventing a decrease in visibility in a high external illumination environment.

The photosensor is a TFT (thin film transistor) device that turns on in response to an external light, and determines the level of an output voltage, which is an illuminance sensing information, by increasing the amount of electric charges discharged through itself according to the amount of received light. A gate voltage (for example, a voltage lower than a threshold voltage for an N-type TFT and a voltage higher than a threshold voltage for a P-type TFT) for not turning on the photosensor by an external driving voltage is supplied at a constant level to the gate electrode of the photosensor. This gate voltage serves as a bias voltage.

However, when a gate voltage of the same polarity is applied for a long time to the gate electrode of the photosensor, the operating characteristics of the photosensor are varied. This is because a threshold voltage level of the photosensor is shifted by a gate-bias stress. In FIG. 1, a rise (Vth0→Vth1) in threshold voltage due to a shift of the operating characteristics to the right is caused by a positive bias stress, while a fall (Vth0→Vth2) in threshold voltage due to a shift of the operating characteristics to the left is caused by a negative bias stress.

Such a change in operating characteristics with time (hereinafter, "time-varying characteristics") of the photosensor causes an increase or decrease of electric current discharged through the photosensor under the same illumination condition. FIG. 2 shows one example in which electric current discharged through the photosensor under the same illumination condition increases due to time-varying characteristics. In FIG. 2, the longitudinal axis indicates electric current Iph discharged through the photosensor, the horizontal axis indicates a drain-source Vds, the dotted line indicates an initial state, and the solid line indicates a state after time variation.

Resultantly, a difference in discharge current amount due to such a change in time-varying characteristics leads to a deviation in output sensing voltage to thus degrade the accuracy of illuminance sensing, and, moreover, becomes a major factor in varying the brightness of a backlight with time regardless of the same illumination condition.

SUMMARY OF THE INVENTION

Accordingly, the present invention is directed to a liquid crystal display that substantially obviates one or ore of the problems due to limitations and disadvantages of the related art.

An advantage of the present invention is to provide a liquid crystal display which can increase the accuracy of illuminance sensing by reducing changes in the time-varying characteristics of a photosensor.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, there is provided a liquid crystal display for adjusting the brightness of a backlight of a liquid crystal display panel in accordance with the illuminance of external light according to an exemplary embodiment of the present invention, comprising: an external light sensing circuit including a photosensor and capacitor connected in parallel to each other and a writing switch connected to the photosensor and capacitor through an output node to charge and discharge the capacitor, and for varying the level of an output voltage applied to the output node in accordance with the illuminance of the external light; and a pulse width modulation (PWM) duty controller for detecting the illuminance of the external light by using the time taken for the output voltage to exceed a predetermined reference voltage, and controlling the duty ratio of a pulse width modulation signal used for controlling the brightness of the back light in accordance with the detected illuminance of the external light, wherein a control signal applied to the gate electrode of the photosensor is generated at a first logic level during a sensing permitting period from the starting point of a write-ON period for charging the capacitor until a specific time point within a write-OFF period for discharging the capacitor, and the control signal is generated at a second logic level for detrapping electric charges trapped in the dielectric layer in the gate electrode due to the first logic level during a sensing blocking period from the specific time point until the finishing point of the write-OFF period.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION

Reference will now be made in detail to an embodiment of the present invention, example of which is illustrated in the accompanying drawings.

Figure 1:
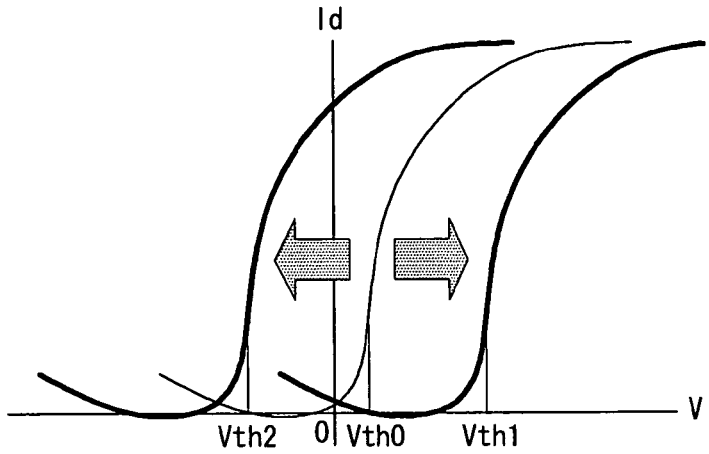
FIG. 1 (Related Art)
FIG. 1 is a view showing a variation in the operating characteristics of a photosensor.
Figure 2:
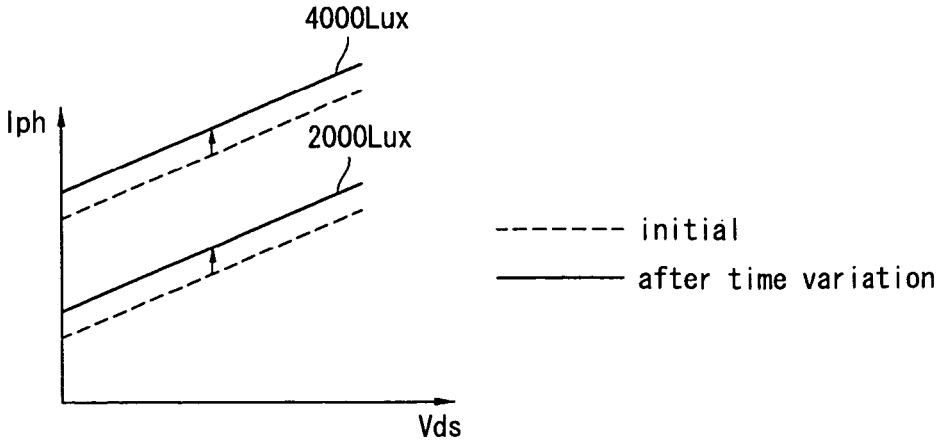
FIG. 2 (Related Art)
FIG. 2 is a view showing one example in which electric current discharged through the photosensor under the same illumination condition increases due to time-varying characteristics in the conventional art.
Figure 3:
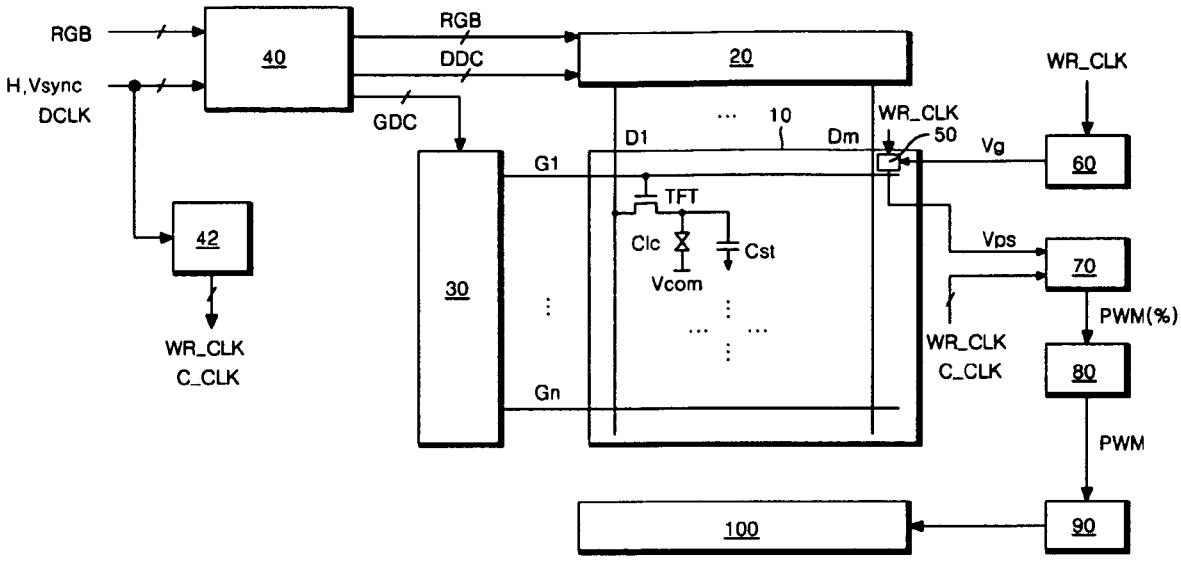
FIG. 3 is a block diagram showing a liquid crystal display according to an exemplary embodiment of the present invention.

Referring to FIG. 3, the liquid crystal display according to an exemplary embodiment of the present invention comprises a liquid crystal display panel 10, a data driving circuit 20, a gate driving circuit 30, a timing controller 40, a clock generator 42, an external light sensing circuit 50, a sensor control signal generator 60, a PWM duty controller 70, a PWM generator 80, a light source driver 90, and a backlight 100.

The liquid crystal display panel 10 comprises liquid crystal formed between two glass substrates. Data lines D1 to Dm and gate lines G1 to Gn formed on a lower glass substrate of the liquid crystal display panel 10 cross each other. A TFT formed at each of intersections of the data lines D1 to Dm and the gate lines G1 to Gn supplies an analog data voltage on the data lines D1 to Dn to a liquid crystal cell Clc in response to a scan pulse from the gate lines G1 to Gn. For this, a gate electrode of the TFT is connected to the corresponding gate line G1 to Gn, and a source electrode is connected to the corresponding data line D1 to Dm. And a drain electrode of the TFT is connected to the pixel electrode of the liquid crystal cell Clc. A black matrix, a color filter and a common electrode (not shown) are also formed on an upper glass substrate of the liquid crystal display panel 10. And polarizers in which the light axes cross each other are stuck to a light exit surface of the upper glass substrate and a light incidence surface of the lower glass substrate of the liquid crystal display panel 10. An alignment film for setting a pre-tilt angle of the liquid crystal is formed in each of a liquid crystal opposite surface of the lower glass substrate and a liquid crystal opposite surface of the upper glass substrate. Further, a storage capacitor Cst is formed in each liquid crystal cell Clc of the liquid crystal display panel 10. The storage capacitor Cst is formed between a pixel electrode of the liquid crystal cell Clc and the previous stage gate line, or between the pixel electrode of the liquid crystal cell Clc and a common electrode line (not shown) to fixedly sustain the voltage of the liquid crystal cell Clc during one frame. An external light sensing circuit 50 for sensing an external light is formed at one side of the liquid crystal display panel 10. A photosensor, which is included in the external light sensing circuit 50, is formed in a region where an external light is not blocked by a black matrix or bezel so that external light can be incident on the photosensor included in the external light sensing circuit 50.

The data driving circuit 20 converts digital video data RGB into analog video signals corresponding to a gray scale value in response to a data control signal DDC from the timing controller 40, and supplies the analog video signals to the data lines D1 to Dm.

The gate driver 30 selects a horizontal line of the liquid crystal display panel 10 supplied with data by sequentially supplying a scan pulse to the gate lines G1 to Gn in response to a gate control signal GDC supplied from the timing controller 40.

The timing controller 40 generates the gate control signal GDC to control the gate driving circuit 30 and the data control signal DDC to control the data driving circuit 30 by using vertically/horizontally synchronized signals Vsync and Hsync and dot clocks DCLK supplied from a system (not shown). The gate control signal GDC includes a gate start pulse GSP, a gate shift clock pulse GSC, a gate output enable signal GOE, and etc. The data control signal DDC includes a source start pulse SSP, a source shift clock signal SSC, a source output enable signal SOE, a polarity control signal POL, and etc. The timing controller 40 re-aligns the digital video data RGB input from the system in accordance with the resolution of the liquid crystal display panel 10 and supplies the re-aligned digital video data to the data driving circuit 20.

The clock generator 42 generates a writing clock WR_CLK used for the operation timing control of each of the external light sensing circuit 50, sensor control signal generator 60 and PWM duty controller 70 with reference to the vertically/horizontally synchronized signals Vsync and Hsync and dot clocks DCLK supplied from the system. Also, the clock generator 42 can generate a count clock C_CLK required in the PWM duty controller 70 with reference to the dot clocks DCLK supplied from the system. This clock generator 42 may be embedded in the timing controller 40.

Figure 4:
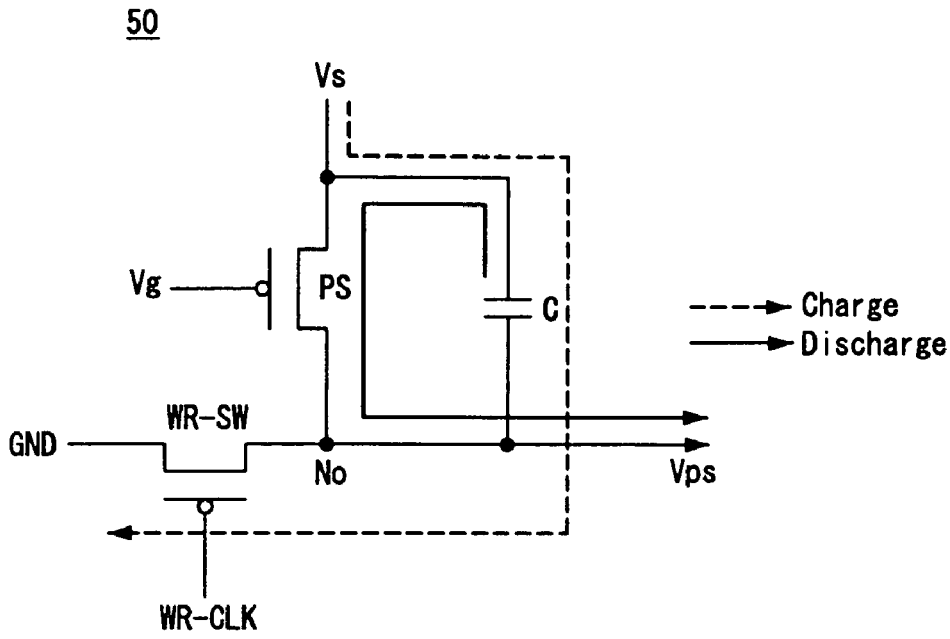
FIG. 4 is a circuit diagram showing an external light sensing circuit of FIG. 3.

The external light sensing circuit 50 includes, as shown in FIG. 4, a photosensor PS, a charge capacitor C, and a writing switch WR_SW.

The photosensor PS is constructed of a P-type TFT comprising a gate electrode supplied with a gate control signal Vg from the sensor control signal generator 60, a source electrode connected to a high potential voltage source Vs, and a drain electrode connected to an output node No. Of course, the photosensor PS may be constructed of an N-type TFT, but the following description will be given of a P-type TFT for the convenience of explanation. The photosensor PS is a TFT device that turns on in response to an external light, and determines the level of an output voltage Vps, which is an illuminance sensing information outputted through the output node No, by increasing the amount of electric charges discharged through itself according to the amount of received light.

One electrode of the charge capacitor C is connected to the high potential voltage source Vs, and the other electrode is connected to the output node No. The charge capacitor C plays the role of charging a voltage from the high potential voltage source Vs and then discharging this charged voltage to the output node No via the photosensor PS when external light is irradiated.

The writing switch WR_SW is constructed of a P-type TFT comprising a gate electrode supplied with a writing clock WR_CLK from the clock generator 42, a source electrode connected to the output node No, and a drain electrode connected to a ground voltage source GND. Of course, the writing switch WR_SW may be constructed of an N-type TFT, but the following description will be given of a P-type TFT for the convenience of explanation. The writing switch WR_SW switches a current path between the high potential voltage source Vs and the ground voltage source GND by turning on and off in response to a writing clock WR_CLK. In other words, the writing switch WR_SW is turned on during a charge period of the charge capacitor C while it is turned off during a discharge period of the charge capacitor C.

Figure 5:
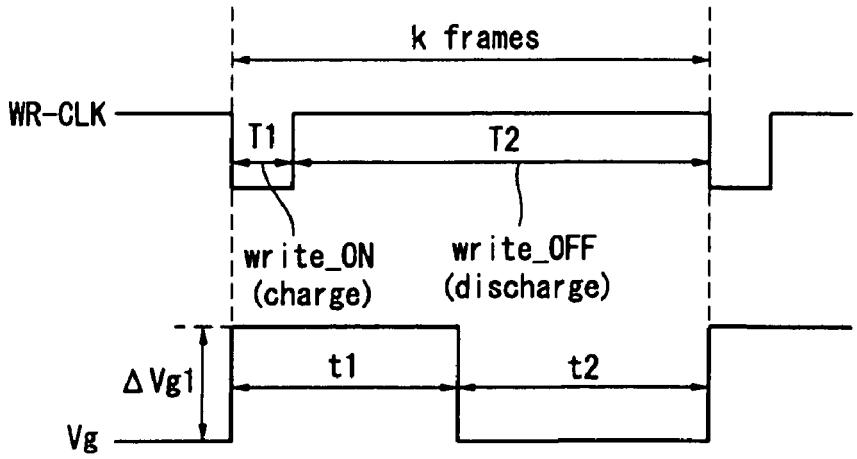
FIG. 5 is a view showing a synchronization timing of a writing clock and a gate control signal.

As shown in FIG. 5, the writing clock WR_CLK is generated at a low logic level for turning on the writing switch WR_SW during a write-ON period T1 corresponding to the charge period of the charge capacitor C, while the writing clock WR_CLK is generated at a high logic level for turning off the writing switch WR_SW during a write-OFF period T2 corresponding to the discharge period of the charge capacitor C. The writing clock WR_CLK having the low logic level is generated periodically in a unit of k frames (k is a natural number of 1 or more).

As shown in FIG. 5, the potential of the gate control signal Vg applied to the gate electrode of the photosensor PS is at the high logic level during the sensing permitting period t1 and the potential thereof is inverted to the low logic level during the sensing blocking period t2 unlike in the conventional art in which the potential is maintained at a constant level DC. Here, the sensing permitting period t1 indicates a period from the starting point of the write-ON period T1 of the writing clock WR_CLK until a specific time point within the write-OFF period T2 of the writing clock WR_CLK. The sensing blocking time t2 indicates a period from the specific time point until the finishing point of the write-OFF period T2 of the writing clock WR_CLK.

A sensing operation of this external light sensing circuit 50 will be described below. When the writing switch WR_SW is turned on in response to the writing clock WR_CLK generated at the low logic level during the write-ON period T1, a current path is formed between the high potential voltage source Vs and the ground voltage source GND with the charge capacitor C disposed therebetween to charge a voltage in the charge capacitor C (see the dotted line of FIG. 4). On the other hand, when the writing switch WR_SW is turned off in response to the writing clock WR_CLK whose potential is inverted to the high logic level during the write-OFF period T2, the voltage stored in the charge capacitor C is outputted to the output node No via the photosensor PS that is turned on in response to an external light (see the solid line of FIG. 4). At this time, the output voltage Vps outputted to the output node No gradually increases with a limit set to the voltage value stored in the charge capacitor C due to an RC discharge. A rate at which the output voltage Vps converges to the limit voltage value increases in proportion to the illumination intensity of external light. By using a variation in the rate of increase of the output voltage Vps depending on the illumination intensity of external light, it is sufficiently possible to sense an external illumination.

Figure 6:
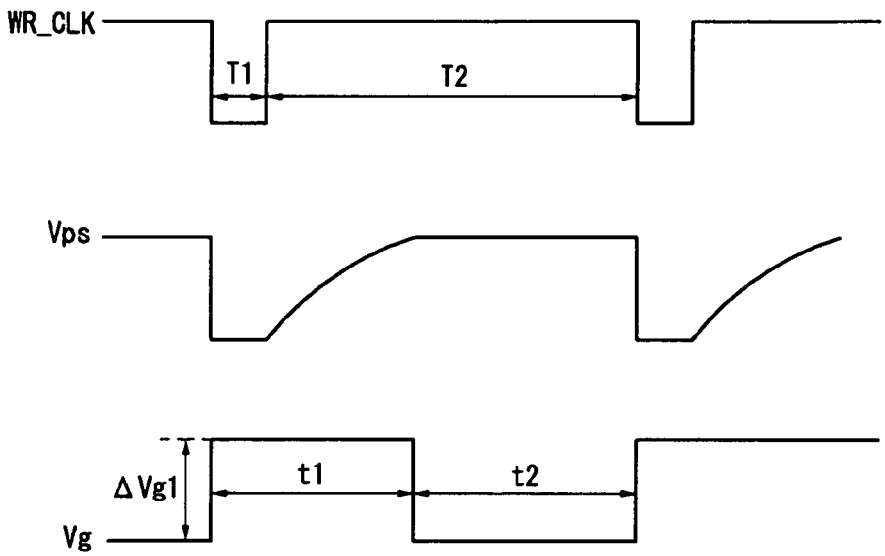
FIG. 6 is a view showing an example in which the sensing duty ratio and the compensation duty ratio are equal to each other.
Figure 7:
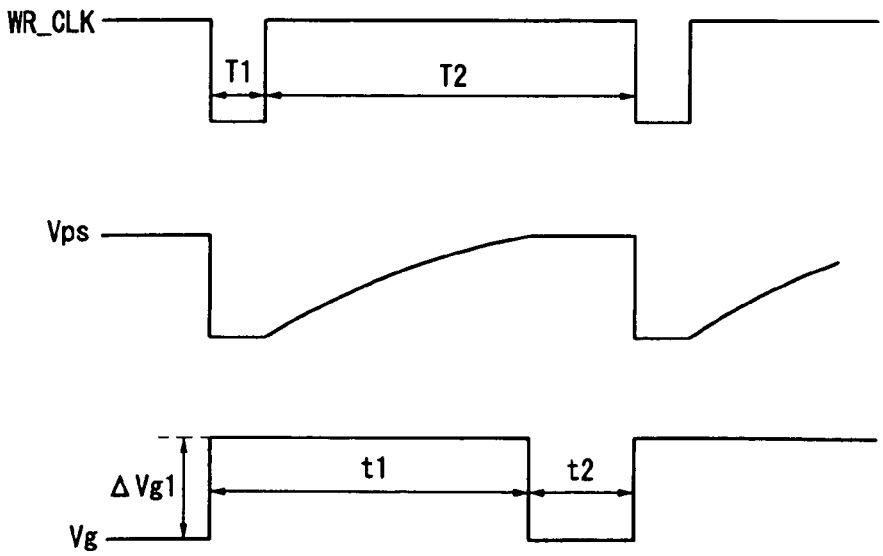
FIG. 7 is a view showing another example in which the sensing duty ratio and the compensation duty ratio are different from each other.

A sensing operation is performed within the sensing permitting period T1 during which the gate control signal Vg is maintained at the high logic level higher than the threshold voltage of the photosensor PS. On the contrary, during the sensing blocking period t2, the gate control signal Vg is generated at the low logic level lower than the threshold voltage of the photosensor PS, thereby compensating for a gate bias stress caused during the sensing permitting period t1. To compensate for such a gate bias stress, the gate control signal Vg may be generated such that the sensing duty ratio and the compensation duty ratio are equal to each other as shown in FIG. 6, or such that the sensing duty ratio is greater than the compensation duty ratio as shown in FIG. 7. Here, the sensing duty ratio is defined as a ratio of one cycle period of the gate control signal Vg to the sensing permitting period t1 maintained at the high logic level, i.e., $\{(t1*100)\%/(t1+t2)\}$, and the compensation duty ratio is defined as a ratio of one cycle period of the gate control signal Vg to the sensing blocking period t2 maintained at the low logic level, i.e., $\{(t2*100)\%/(t1+t2)\}$. The higher the sensing duty ratio, the less the compensation duty ratio, while, the less the sensing duty ratio, the higher the compensation duty ratio.

Figure 8:
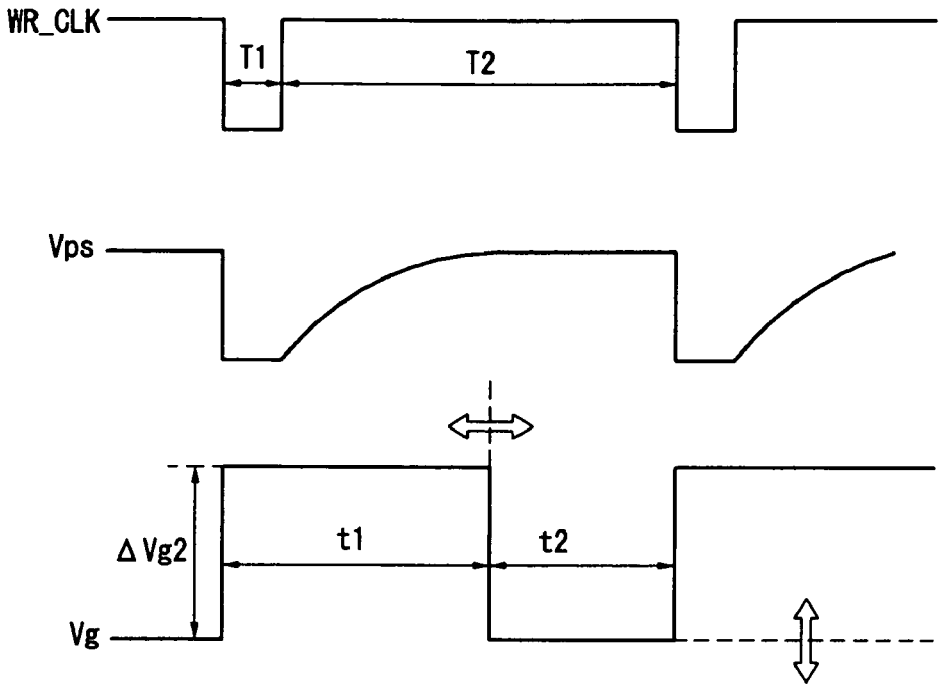
FIG. 8 is a view for explaining that the smaller the compensation duty ratio, the larger the amplitude of the gate control signal.

The sensing duty ratio is associated with sensing speed, sensing sensitivity and so on, and the compensation duty ratio is associated with a compensation capability. Here, the sensing speed means how fast external illuminance is sensed, the sensing sensitivity means how low external illuminance can be sensed, and the compensation capability means how much the gate bias stress can be relieved. In FIG. 7 in which the sensing duty ratio is relatively higher than that of FIG. 6, the sensing speed is low but the sensing sensitivity can be greatly increased. However, the compensation capability of FIG. 7 is low because the compensation duty ratio is relatively lower than that of FIG. 6. To increase such compensation capability, in the present invention, the smaller the compensation duty ratio as shown in FIG. 8, the larger the amplitude $\Delta Vg2$ of the gate control signal Vg can be made than the amplitude $\Delta Vg1$ of the gate control signal Vg as shown in FIG. 6. In this manner, the larger the amplitude $\Delta Vg2$ of the gate control signal Vg, the greater the force of detrapping the electric charges trapped in the dielectric layer in the gate electrode of the photosensor PS due to a gate bias stress, thereby improving the compensation capability. Meanwhile, it is not preferable that the compensation duty ratio is greater than the sensing duty ratio. This is because a gate bias stress in the opposite direction is accumulated in the gate electrode of the photosensor PS by a gate control signal of the opposite logic level in a compensation process because of an excessive compensation capability.

Figure 9:
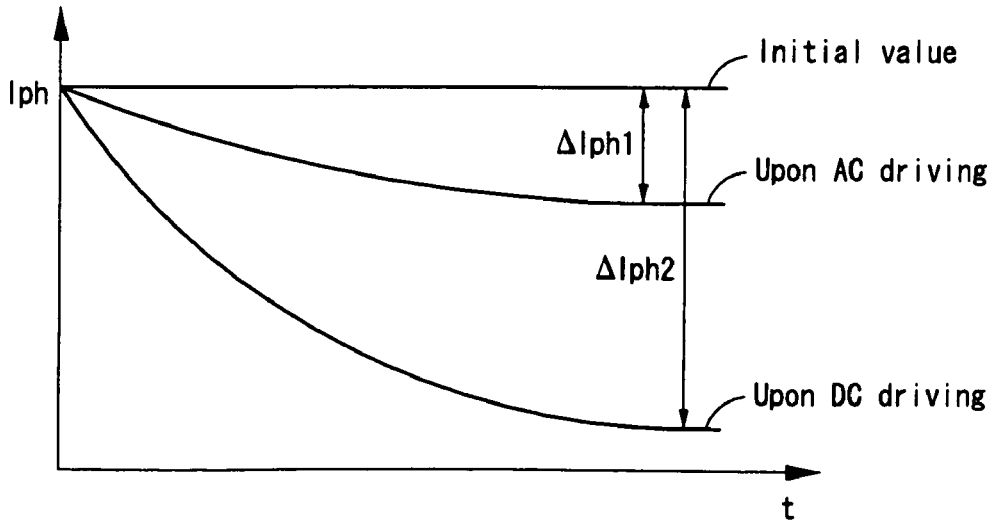
FIG. 9 is a view showing a discharge current variation width of a photosensor with time under the same illumination condition.

As a result, the present invention can greatly reduce a discharge current variation width $\Delta Iph1$ of the photosensor PS with time t under the same illumination condition compared to the conventional discharge current variation width $\Delta Iph2$ as shown in FIG. 9 by applying a gate control signal Vg of alternating current (AC) form to the gate electrode of the photosensor PS. This is because changes in the time-varying characteristics of the photosensor PS can be drastically reduced by the compensation of the above-described gate bias stress. In order to accurately perform external illuminance sensing it is important to reduce such changes in time-varying characteristics more than anything else.

The sensor control signal generator 60 generates a gate control signal Vg, whose potential is at the high logic level during the sensing permitting period t1 and inverted to the low logic level during the sensing blocking period t2, in synchronization with the writing clock WR_CLK from the clock generator 42. As explained above, the compensation duty ratio and amplitude of the gate control signal Vg can be varied variously according to applications in consideration of sensing speed and sensing sensitivity as well as compensation capability.

Figure 10:
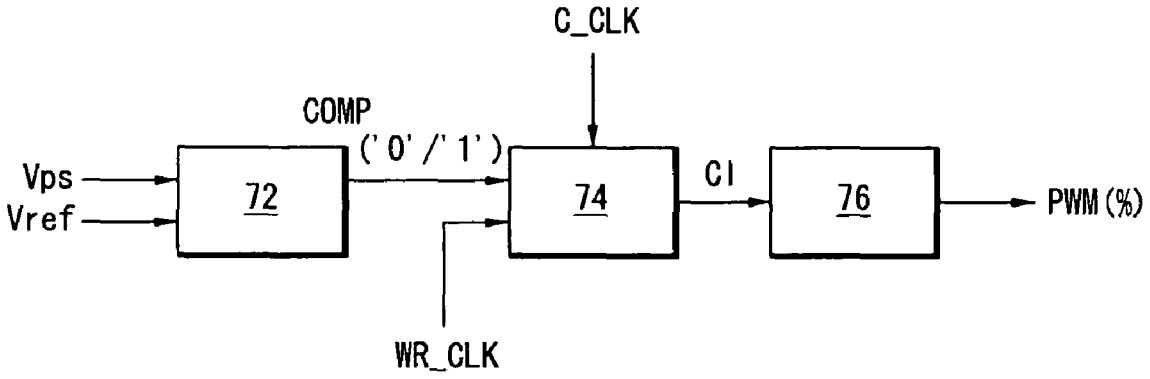
FIG. 10 is a block diagram showing a PWM duty controller of FIG. 3 in detail.

The PWM duty controller 70 detects the illuminance of external light by using the time taken for the output voltage Vps to exceed a predetermined reference voltage Vref, and controls the duty ratio of a pulse width modulation signal PWM in response to the detected illuminance. For this, the PWM duty controller 70 comprises a comparison unit 72, a counter 74, and a duty ratio control unit 76 as shown in FIG. 10.

The comparison unit 72 generates a digital comparison signal COMP at different logic values in accordance with whether the level of the output voltage Vps from the external light sensing circuit 50 exceeds the level of the reference voltage Vref or not. For outputting such a comparison signal COMP, an analog-digital converter may be included in the comparison unit 72. If the output voltage Vps is smaller than the reference voltage Vref, the comparison signal COMP is generated at a first logic value (for example, '0'), and if the output voltage Vps is larger than the reference voltage Vref, the comparison signal COMP is generated at a second logic value (for example, '1'). Here, it is preferred that the smaller the sensing duty ratio, the lower the level of the reference voltage Vref is set to increase sensing sensitivity.

Figure 11:
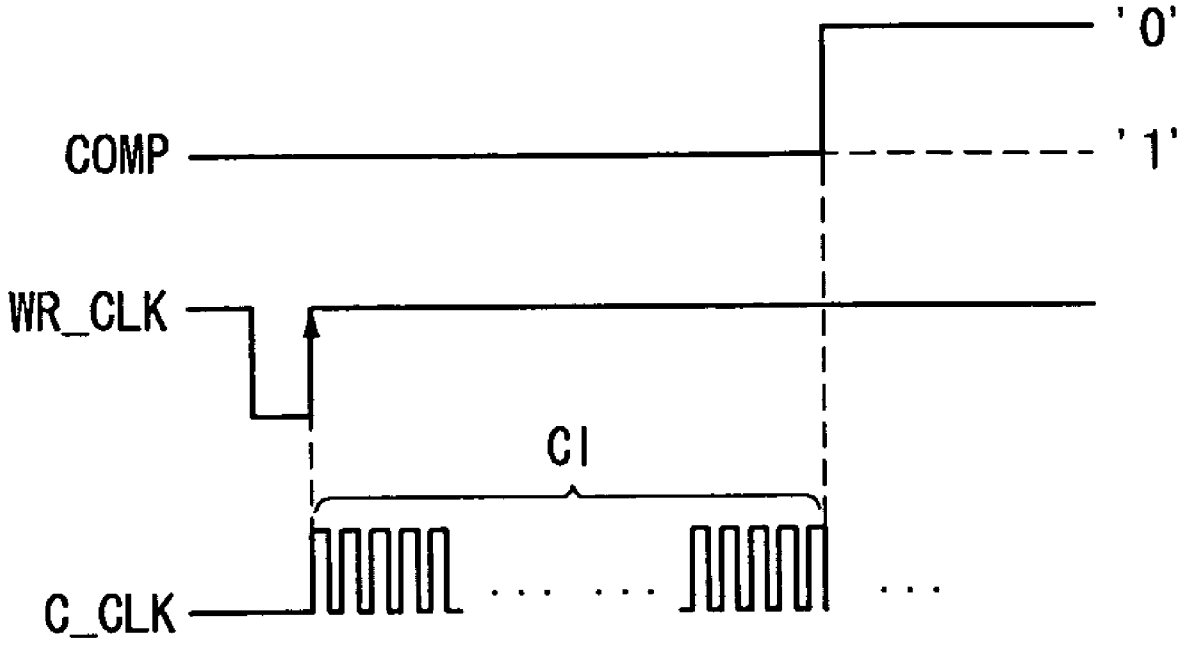
FIG. 11 is a view for explaining a counting operation of a counter of FIG. 10.

As shown in FIG. 11, the counter 74 counts until the moment when a logic value of the comparison signal COMP from the comparison unit 72 is changed by using a count clock C_CLK from the clock generator 42, and generates count information CI according to the result of the counting. Since, the higher the external illuminance, the more the current discharged via the photosensor PS, the time taken for the output voltage Vps to exceed the reference voltage Vref is reduced, and hence, the count value tends to become smaller. On the other hand, the lower the external illuminance, the smaller the count value tends to become. As shown in FIGS. 6 to 8, the counter 74 starts counting in synchronization with the starting point of the write-OFF period of the writing clock WR_CLK when the output voltage Vps starts to increase. Meanwhile, the count clock C_CLK used for a counting operation in the counter 74 may be generated through an internal oscillation circuit (not shown) instead of the clock generator 42.

The duty ratio control unit 76 generates duty information (PWM (%)) used to control the duty ratio of a pulse width modulation signal PWM for the control of the turning-on of the backlight 100 by using the count information CI having a value according to external illuminance inputted from the counter 74. For this, the duty ratio control unit 76 may comprise a lookup table storing a plurality of duty information corresponding to a plurality of count information CI on a one-to-one basis. The duty ratio control unit 76 can read out duty information of a pulse width modulations signal PWM from the lookup table by using the count information CI as a read address.

The PWM generator 80 generates a pulse width modulation signal PWM for controlling the luminance of the backlight 100. The PWM generator 80 varies the duty ratio of the pulse width modulation signal PWM in response to the duty information (PWM (%)) from the PWM duty controller 70.

The light source driver 90 drives the light source of the backlight 100 in accordance with a pulse width modulation signal PWM inputted from the PWM generator 80. In other words, the larger the duty ratio of the pulse width modulation signal PWM becomes, the more the light source driver 90 increases the light source turn-on period, thereby increasing the luminance of the backlight 100, while the smaller the duty ratio of the pulse width modulation signal PWM becomes, the less the light source driver 90 reduces the light source turn-on period, thereby decreasing the luminance of the backlight 100. Consequently, the luminance 100 of the backlight 100 is controlled in proportion to external illuminance.

As seen from above, the liquid crystal display according to the present invention can increase the accuracy of illuminance sensing by a reduction of a discharge current variation width of the photosensor with time under the same illumination condition by applying a gate control signal of alternating current form to the gate electrode of the photosensor and reducing changes in the time-varying characteristics of the photosensor.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A liquid crystal display for adjusting a brightness of a backlight of a liquid crystal display panel in accordance with an illuminance of external light, comprising:

an external light sensing circuit including:

a photosensor;

a capacitor connected in parallel to the photosensor; and a writing switch connected to the photosensor and the capacitor through an output node to charge and discharge the capacitor, and for varying a level of an output voltage applied to the output node in accordance with the illuminance of the external light; and a pulse width modulation (PWM) duty controller for detecting the illuminance of the external light by using a time taken for the output voltage to exceed a predetermined reference voltage, and controlling a duty ratio of a pulse width modulation signal used for controlling the brightness of the back light in accordance with a detected illuminance of the external light, wherein a control signal applied to a gate electrode of the photosensor is generated at a first logic level during a sensing permitting period from a starting point of a write-ON period for charging the capacitor until a specific time point within a write-OFF period for discharging the capacitor, and the control signal is generated at a second logic level for detrapping electric charges trapped in a dielectric layer in the gate electrode due to the first logic level during a sensing blocking period from the specific time point until a finishing point of the write-OFF period, wherein an amplitude of the control signal and a length of a maintenance period of the second logic level of the control signal are varied according to an amount of electric charges trapped in the dielectric layer in the gate electrode and a sensing speed and a sensing sensitivity for sensing the illuminance of external light.

2. The liquid crystal display of claim 1, wherein a maintenance period of the first logic level is equal to the maintenance period of the second logic level.

3. The liquid crystal display of claim 1, wherein a maintenance period of the first logic level is longer than the maintenance period of the second logic level.

4. The liquid crystal display of claim 1, wherein the shorter the maintenance period of the second logic level is than a maintenance period of the first logic level, the larger the amplitude of the control signal is.

5. The liquid crystal display of claim 1, wherein the PWM duty controller comprises:

a comparison unit for generating a digital comparison signal at different logic values in accordance with whether a level of the output voltage exceeds a level of the reference voltage;

a counter for generating count information by counting until the moment when a logic value of the comparison signal is changed by using a count clock; and a duty ratio control unit for generating duty information used to control the duty ratio of the pulse width modulation signal for the control of a turning-on of the backlight by using the count information.

6. The liquid crystal display of claim 5, wherein the shorter the maintenance period of the first logic level is, the lower the level of the reference voltage is.

7. The liquid crystal display of claim 5, wherein the duty ratio controller comprises a lookup table storing a plurality of duty information corresponding to a plurality of count information on a one-to-one basis, and reads out the duty information by using the count information as a read address.

* * * * *